US007886945B2

(12) United States Patent
Fitzgerald et al.

(10) Patent No.: US 7,886,945 B2
(45) Date of Patent: Feb. 15, 2011

(54) GARMENT HANGER

(75) Inventors: Thomas Fitzgerald, Lake Elizabeth, CA (US); John Caper, Valencia, CA (US); James Hale, Thousand Oaks, CA (US); Brian J. Lunniss, Long Beach, CA (US)

(73) Assignee: Mechanix Wear, Inc., Valencia, CA (US)

( * ) Notice: Subject to any disclaimer, the term of this patent is extended or adjusted under 35 U.S.C. 154(b) by 0 days.

(21) Appl. No.: 11/698,618

(22) Filed: Jan. 25, 2007

(65) Prior Publication Data

US 2007/0119880 A1 May 31, 2007

Related U.S. Application Data

(63) Continuation-in-part of application No. 11/001,457, filed on Nov. 30, 2004, now abandoned.

(60) Provisional application No. 60/836,551, filed on Aug. 8, 2006.

(51) Int. Cl.
*A41D 27/22* (2006.01)

(52) U.S. Cl. ..... 223/85; 223/87

(58) Field of Classification Search ..... 223/85, 223/87, 91, 93, 97, 96; 40/607.12, 611.12, 40/617; 24/3.11, 3.12, 326, 331, 335, 338, 24/343

See application file for complete search history.

(56) References Cited

U.S. PATENT DOCUMENTS 1,682,106 A * 8/1928 Banks ..... 40/322
1,997,251 A * 4/1935 Field ..... 223/90
2,408,145 A * 9/1946 Johnson ..... 223/96
2,421,307 A * 5/1947 Albrecht ..... 223/96
2,889,092 A * 6/1959 Gibron ..... 223/91
3,041,696 A * 7/1962 Ferri, Jr. ..... 24/566
3,755,859 A * 9/1973 Solari ..... 223/87
3,997,091 A * 12/1976 Burnette ..... 223/87
4,261,121 A * 4/1981 Coon ..... 40/332
4,876,771 A 10/1989 Givati ..... 24/298
4,878,276 A * 11/1989 Morrish et al. ..... 24/511
4,884,726 A * 12/1989 Kolton et al. ..... 223/91
4,943,026 A * 7/1990 Fildan ..... 248/339
5,013,004 A * 5/1991 Wilkins et al. ..... 248/692
5,072,866 A * 12/1991 Kolton et al. ..... 223/91
D328,418 S * 8/1992 Becklund ..... D8/373
5,177,881 A 1/1993 Moore ..... 34/239
5,241,728 A * 9/1993 Hunter ..... 24/511
5,261,580 A * 11/1993 Smith ..... 223/85
5,402,558 A * 4/1995 Santapa ..... 24/511
5,413,301 A * 5/1995 Cadman ..... 248/340

(Continued)

*Primary Examiner*—Gary L Welch
*Assistant Examiner*—Nathan E Durham
(74) *Attorney, Agent, or Firm*—Koppel, Patrick, Heybl & Dawson

(57) ABSTRACT

A garment hanger comprises a header card and a clamp, the header card being preferably "free-floating" relative to the clamp to give a prospective purchaser a sense that the clamp is attached more to the garment than to the header card and that the card is thus disposable after purchase. In one embodiment, a hanger for displaying and holding an article such as a pair of gloves comprises a clothespin-like clamp comprising a pair of jaws resiliently biased about a pivot region to a closed, article-holding position, and a header defining an opening for receiving the pivot region of the clamp. Preferably, the opening in the header is larger than the pivot region of the clamp so as to provide for relative movement between the clamp and the header.

22 Claims, 6 Drawing Sheets

U.S. PATENT DOCUMENTS 5,435,447 A 7/1995 Weatherford et al. ..... 206/349
5,492,616 A 2/1996 Cook et al. ..... 206/591
5,595,331 A * 1/1997 Leistner ..... 223/91
5,640,742 A * 6/1997 White et al. ..... 24/3.12
5,695,161 A * 12/1997 Brozak, Jr. ..... 248/215
5,826,760 A * 10/1998 Kolton et al. ..... 223/85
5,864,925 A 2/1999 McGee ..... 24/3.11
5,934,525 A * 8/1999 Blanchard ..... 223/96
5,944,236 A * 8/1999 Cinque ..... 223/1
5,983,518 A 11/1999 Ellenburg ..... 34/106
5,988,381 A * 11/1999 Ling ..... 206/349
6,010,044 A 1/2000 Hsiao ..... 223/85
6,023,818 A * 2/2000 Shang ..... 24/501
D432,910 S * 10/2000 Caper ..... D9/415
6,161,708 A 12/2000 Myler ..... 211/90.02
6,206,253 B1 * 3/2001 Kolton et al. ..... 223/85
6,276,529 B1 8/2001 Feehan, Jr. ..... 206/469
6,499,227 B1 12/2002 Jacobson ..... 34/106
6,523,703 B1 2/2003 Robertson ..... 211/59.3
6,745,924 B2 * 6/2004 Woodworth ..... 223/87
2002/0104858 A1 * 8/2002 Woodworth ..... 223/85
2003/0126725 A1 * 7/2003 Housley ..... 24/510

* cited by examiner

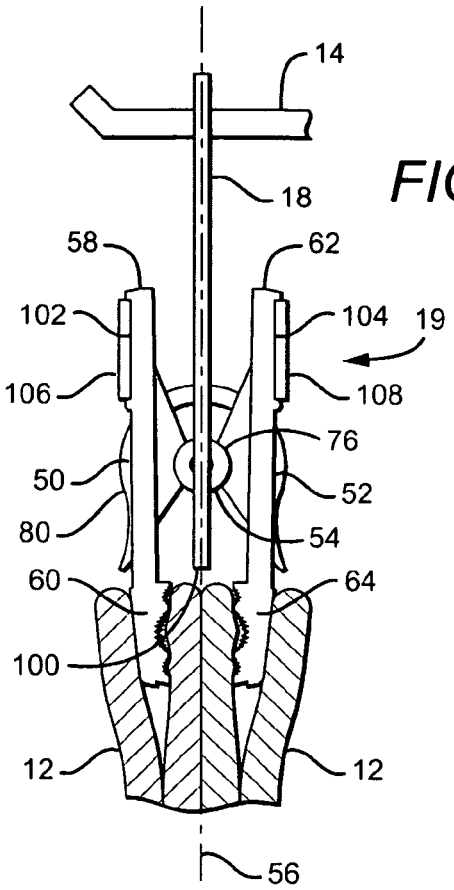
FIG. 3
FIG. 4
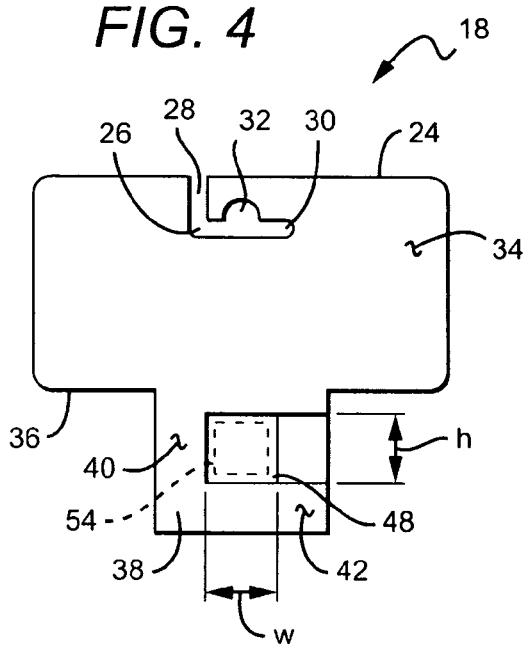
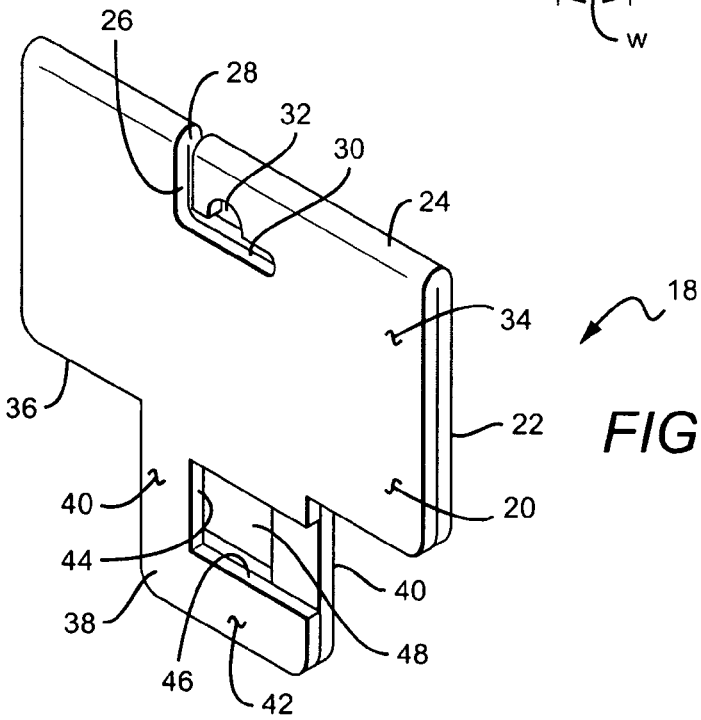
FIG. 5

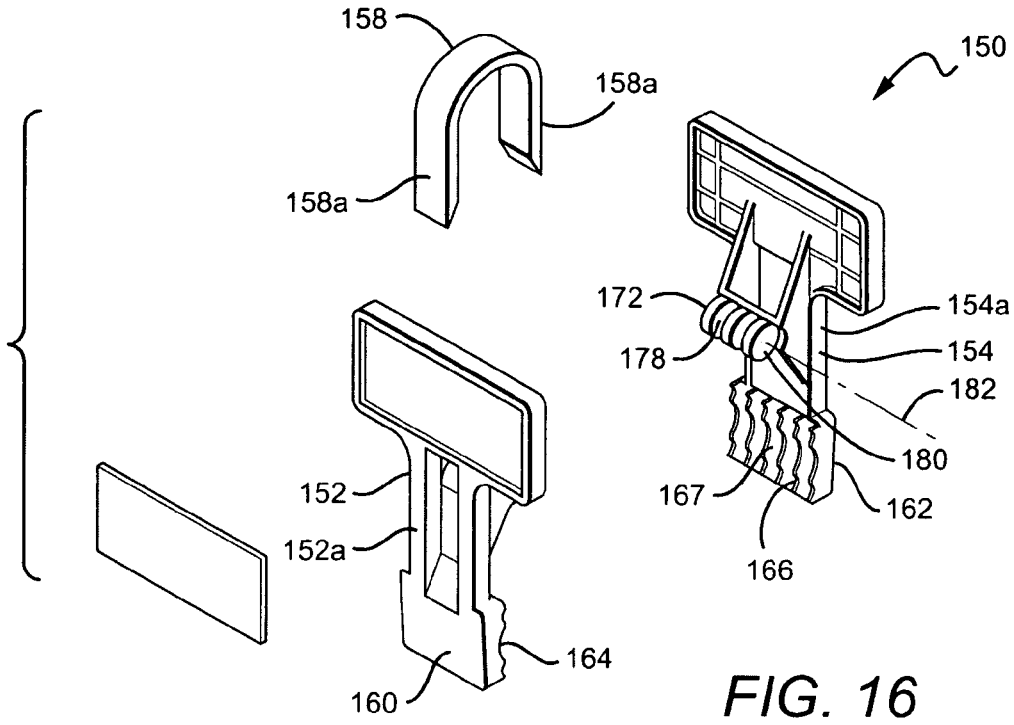
FIG. 16
FIG. 17
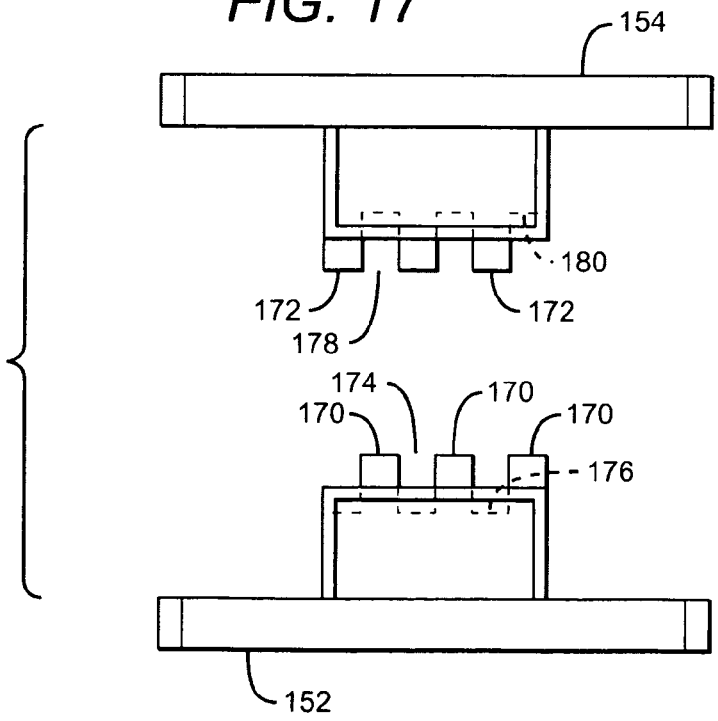

GARMENT HANGER

CROSS REFERENCES TO RELATED APPLICATIONS

This application is a continuation-in-part of U.S. patent application Ser. No. 11/001,457, filed Nov. 30, 2004 now abandoned and titled "Garment Hanger Apparatus and Method"; that application is incorporated by reference herein in its entirety. This application also claims the benefit of U.S. Provisional Application No. 60/836,551 filed Aug. 8, 2006 and titled "Garment Hanger"; the Provisional Application is incorporated by reference herein in its entirety.

FIELD OF THE INVENTION

The present invention relates generally to garment packaging and particularly to a hanger for holding garments such as gloves.

BACKGROUND OF THE INVENTION

Garments shipped to retail stores may be individually sealed in a plastic packaging structure such as an envelope or a clamshell package. A clamshell-type package is disclosed in U.S. Pat. Nos. 5,435,447 and 6,276,529 while an envelope-type package is disclosed in U.S. Pat. No. 5,492,616. The plastic packaging structure protects the garment from damage during shipment and keeps matching garments together. Where the matching garments comprise a pair of gloves, the plastic packaging structure containing the gloves may be mounted on a merchandise display for a customer to view and purchase. One type of plastic structure includes a hole at one end such that the structures may be hung from a horizontal rod for display.

One disadvantage of envelope and clamshell packaging is that such packaging has to be opened by a potential purchaser in order to try the gloves on to be sure they fit. Oftentimes the gloves are then left out of their package or they are improperly returned to the package. Another disadvantage is that after the gloves have been purchased, the packaging structure is typically discarded after the gloves have been removed. This tends to be wasteful. Still another disadvantage is that after the gloves are purchased and in use, it is easy to misplace one or both of the gloves, or to store them in a location where they might become damaged.

One way to reduce these problems is to use a glove hanger an example of which is shown in U.S. Pat. No. 6,010,044. The '044 patent discloses a hanger for holding and displaying hockey gloves on a clothing store rack in an aesthetically pleasing manner for the consumer. The consumer can also use the hanger after purchase to store the gloves, for example, in a closet. One problem with this glove hanger, however, is that it has limited utility because it is specifically designed for carrying large and bulky gloves on a clothing rack in a retail store.

SUMMARY OF THE INVENTION

In accordance with one, specific, exemplary embodiment of the invention, there is provided a hanger for displaying and holding an article such as a pair of gloves, the hanger comprising a clothespin-like clamp comprising a pair of jaws resiliently biased about a pivot region to a closed, article-holding position, and a header defining an opening for receiving the pivot region of the clamp.

It is desirable in retailing to display products to shoppers in a way that attracts attention and facilitates selection and purchase. In accordance with a preferred aspect of the present invention, this goal is met by making the header "free-floating" relative to the clamp to give a prospective purchaser a sense that the clamp is attached more to the garment than to the header and that the header is thus disposable after purchase. More specifically, the opening defined by the header may be made larger than the pivot region residing within the opening to provide the desired relative movement between the clamp and the header.

In one form of the invention, the header may comprise a sheet folded along a fold edge to define confronting sides of the header. Preferably, each of the confronting sides may include a lower edge parallel with the fold edge and a portion depending from the lower edge, the depending portions of the confronting sides defining the opening. Further, each of the depending portions may have an L-shaped configuration.

According to another aspect of the invention, the clamp may comprise a pair of opposed arms pivotable about the pivot region. Preferably, each of the arms comprises a first end including a manually grippable portion and a second end carrying one of the jaws of the pair of jaws. In one form of the invention, each of the arms of the pair of arms defines a pivot bearing surface, the pivot bearing surfaces defined by the pair of arms being in confronting relationship, the pivot region further comprising a pivot pin seated within the confronting bearing surfaces.

In yet another form of the invention, each of the arms of the pair of arms defines alternating bearing elements and bearing sockets, the bearing elements on one of the arms being interdigitated with the bearing elements on the other of the arms and received within corresponding bearing sockets on the other arm.

BRIEF DESCRIPTION OF THE DRAWINGS

The foregoing and other objects, features and advantages of the invention will be evident to those skilled in the art from the detailed description below, taken together with the accompanying drawings, in which:

FIG. 3 is a side elevation view, partly in cross section, of the garment hanger of FIG. 2;

FIG. 4 is a front elevation view of one embodiment of a header card forming part of the garment hanger of FIGS. 1-3;

FIG. 5 is a perspective view of the header card of FIG. 4;

FIG. 16 is an exploded, perspective view of the clamp of FIG. 12, and

FIG. 17 is a schematic, top plan view of the clamp of FIG. 12 illustrating the pivot region thereof.

DETAILED DESCRIPTION OF THE INVENTION

The following description is of a best mode presently contemplated for practicing the invention. This description is not to be taken in a limiting sense but is made merely for the purpose of describing the general principles of the invention whose scope may be ascertained by referring to the appended claims. For purposes of this description, directional terms such as "upper", "lower", and the like are used for convenience only and are not to be construed as necessarily limiting the described element to a particular orientation during use.

Figure 1:
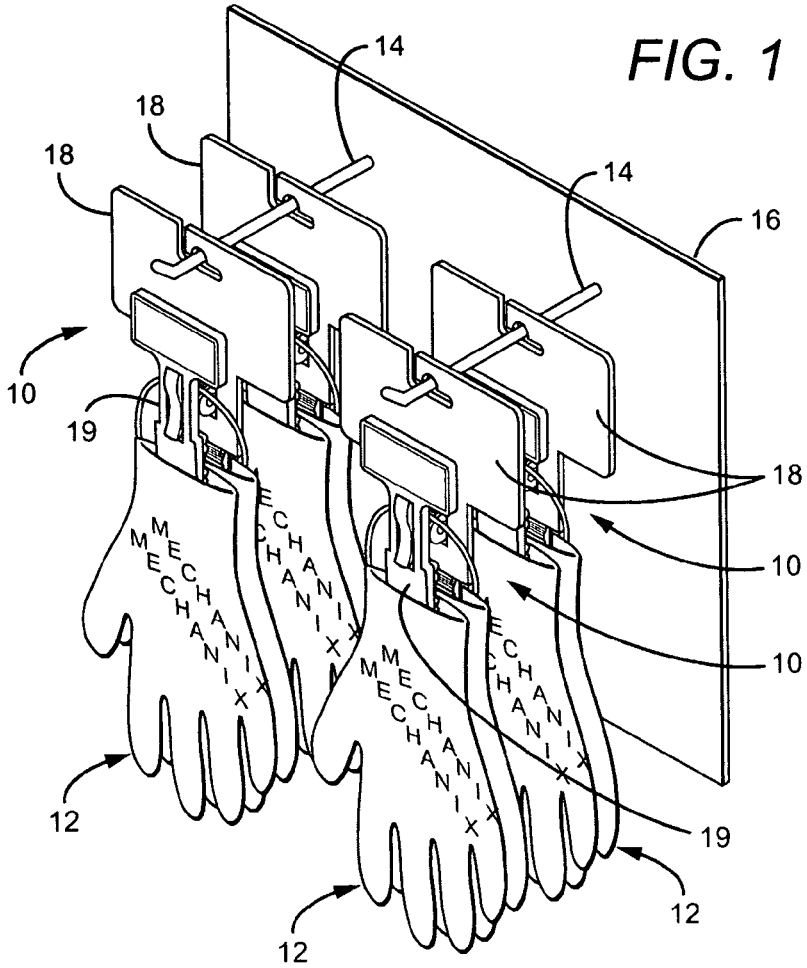
FIG. 1 is a perspective view of a retail store display carrying multiple garment hangers incorporating features of the present invention.

Referring to the drawings, there is shown in FIGS. 1-10 a specific, exemplary, preferred embodiment of a hanger 10 for holding and displaying an article 12 such as a garment, and specifically a pair of gloves. As shown in FIG. 1, multiple hangers 10, each with a pair of matching gloves 12 attached, may be suspended from rods 14 projecting from a point-of-sale display 16 of the kind typically found in a retail establishment.

The hanger 10 generally comprises a header 18 and a spring-loaded clamp 19, one of the features of the invention being the co-action between the header and the clamp.

With reference to FIGS. 1-6, the header 18 is preferably in the form of a card comprising a pair of confronting sides 20 and 22 joined along an upper fold edge 24. The card is preferably formed from a single, transparent plastic sheet back-printed with, for example, a product logo and other information. The plastic sheet may have a thickness of, for example, 0.020 inch. Formed along the upper, folded edge 24 is a central cutout 26 having, in the particular embodiment under consideration, an L-shaped configuration with a vertical portion 28 extending downwardly from the upper edge 24 and a horizontal portion 30 which may include an upwardly extending pocket 32. The cutout 26 is thus configured to receive a rod 14 projecting from the retail merchandise display 16 with the pocket 32 being adapted to be engaged by the rod 14 to stabilize the lateral position of the hanger.

The header sides 20 and 22 are generally mirror images of each other; accordingly, only the side 20 will be described in detail.

Figure 6:
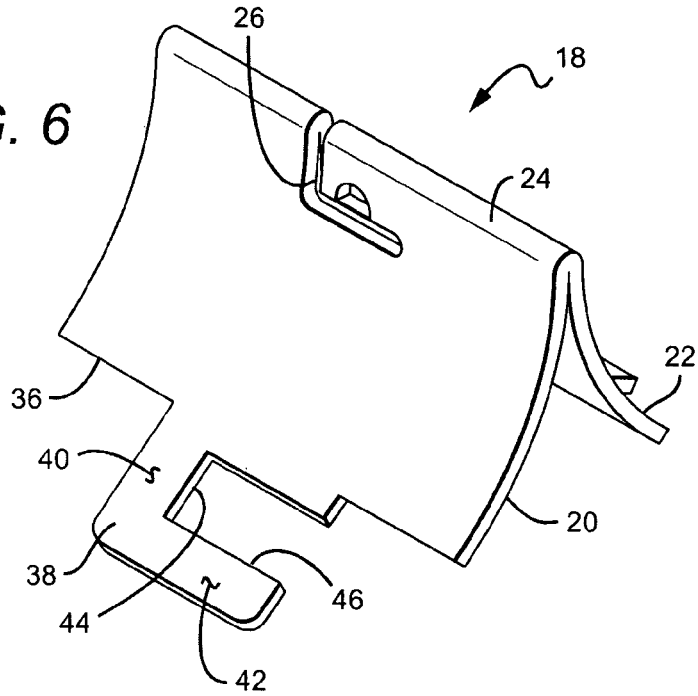
FIG. 6 is a perspective view of the header card of FIG. 4 showing confronting sides thereof spread apart.
Figure 7:
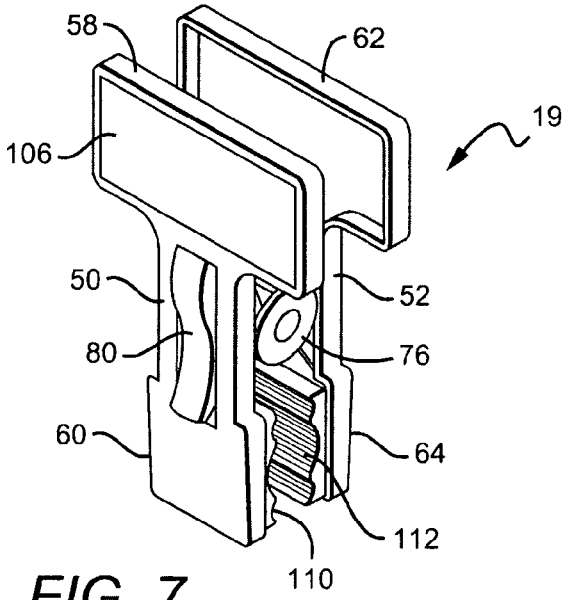
FIG. 7 is a perspective view of one embodiment of a clamp forming part of the garment hanger of FIGS. 1-3.
Figure 12:
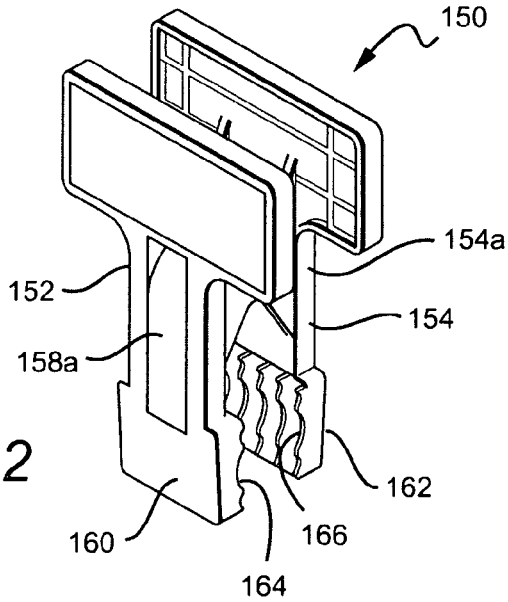
FIG. 12 is a perspective view of a garment hanger clamp in accordance with another embodiment of the invention.
Figure 8:
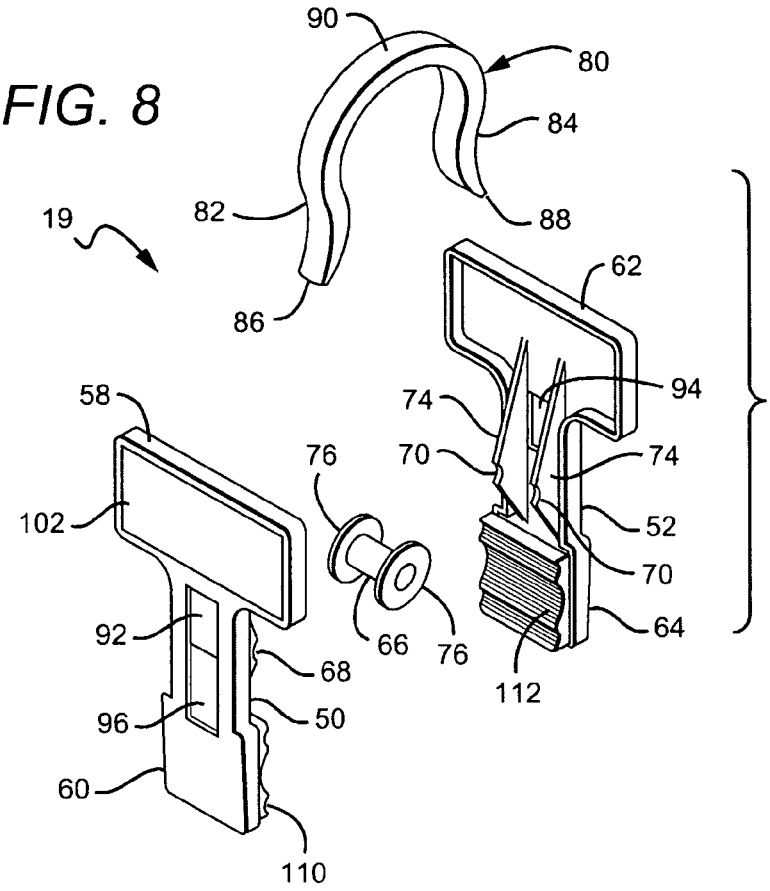
FIG. 8 is an exploded, perspective view of the clamp depicted in FIG. 7.
Figure 9:
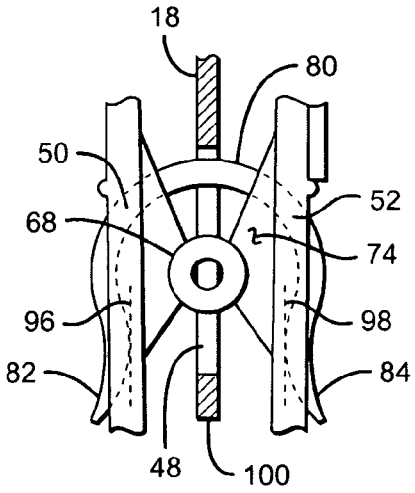
FIG. 9 is a partial, side elevation view of the clamp of FIG. 7 showing a pivot region of the clamp.
Figure 10:
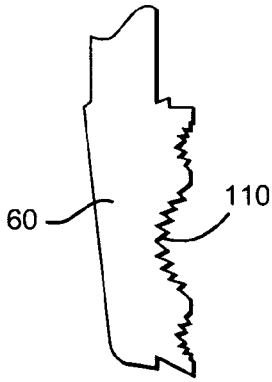
FIG. 10 is a side elevation view of a jaw forming part of the clamp of FIGS. 7 and 8.

The header side 20 comprises a main portion 34 having, in this particular embodiment, a generally rectangular configuration including a lower edge 36 extending parallel with the fold edge 24. Depending from the lower edge 36 of the main portion 34 is an L-shaped extension or flap 38 having a vertical portion 40 extending from the lower edge 36 and a horizontal portion 42 projecting from the lower end of the vertical portion 40. The vertical and horizontal portions 40 and 42 have inner edges 44 and 46, respectively. With the header sheet folded as shown in FIGS. 4 and 5, the header sides 20 and 22 and the horizontal portions 40 of the flaps 38 are in confronting relationship, with the inner edges 44 and 46 of the depending L-shaped flaps defining a generally square or rectangular opening 48. As will be described below, the opening 48 is adapted to receive the pivot region of an associated garment clamp 19. The sides 20 and 22 of the header 18 may be spread apart as shown in FIG. 6 to facilitate attaching a header to an associated clamp 19.

Referring now also to FIGS. 7-10, in one form, the clamp 19 generally comprises a clothespin-like structure including a pair of opposed, rigid, elongated arms 50 and 52 interconnected at a pivot region 54 between the arms. In accordance with the preferred embodiment, in side view, the clamp 19 has a construction that is substantially symmetrical about a central, vertical plane 56 (FIG. 3). The arm 50 comprises a first or upper end including a manually grippable portion 58 and a second or lower end, opposite the first end, including a jaw portion 60. Similarly, the arm 52 comprises a first or upper end including a manually grippable portion 62 and a second or lower end, opposite the portion 62, including a jaw portion 64. The pivot region 54 is disposed between the first and second ends of the arms 50 and 52 and incorporates a pivot pin 66 received by confronting, arcuate bearing surfaces 68 and 70 formed in laterally spaced-apart, inwardly directed projections 72 and 74, respectively, forming parts of the arms 50 and 52. The pivot pin 66 includes a radially-extending retaining flange 76 at each end of the pin to retain the pivot pin within the confines of the bearing surfaces 68 and 70.

Figure 2:
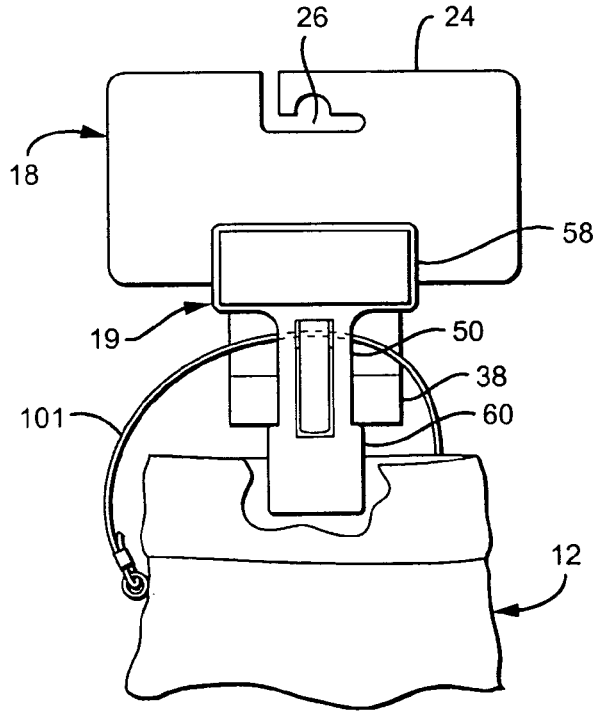
FIG. 2 is a front elevation view, partly cut away, showing an exemplary embodiment of a garment hanger according to the invention.

The clamp 19 further comprises a generally U-shaped spring clip 80 including opposed legs 82 and 84 having lower, free ends 86 and 88, respectively, and a central, bridging portion 90 connecting the legs 82 and 84 opposite the free ends thereof. The arms 50 and 52 include openings 92 and 94, respectively, located between the pivot region 54 and the upper or first ends 58 and 62 of the arms through which the bridging portion 90 of the U-shaped spring passes. In this fashion, the legs 82 and 84 of the spring clip are positioned along outer surfaces 96 and 98 of the arms 50 and 52 respectively, with the free ends 86 and 88 of the U-shaped spring clip engaging the outer surfaces of the arms at points between the pivot region 54 and the jaw portions 60 and 64. The U-shaped spring clip 80 is thus disposed to urge the jaw portions 60 and 64 toward each other to clamp and hold the gloves 12 or other article (FIGS. 1-3). Squeezing the manually grippable portions 58 and 62 toward each other causes the jaw portions 60 and 64 to move apart against the bias of the U-shaped clip 80. It will be seen that the jaw portions are disposed below and clear of a lower edge 100 of the header card's depending portion 36 so that the jaw portions 60 and 64 may move into engagement with each other without obstruction. The pivot region 54 of the clamp 19 is disposed within the opening 48 defined by the depending portion 38 of the header 18 to thereby couple the header and the clamp. The height, h, and the width, w, of the opening 48 in the header 18 (FIG. 4) exceed the height and width of the pivot region 54 (shown schematically in broken lines within the opening in FIG. 4) so that relative horizontal and vertical movement, preferably substantial in range, is facilitated between the clamp 19 and the header 18 to provide a "free-floating" connection between the two. This imparts to a prospective purchaser a sense that the clamp is attached more to the gloves than to the header, thus suggesting that the header is removable from the clamp and disposable after purchase.

As shown in FIG. 2, each of the gloves 12 may be attached to the header 18 by means of a preferably elastic tether 101 passed through the space between the pivot region and the spring clip and attached at its ends to the gloves. Preferably, the tether 101 is of sufficient length to permit a prospective purchaser to try on the gloves in a retail establishment without separating them from the hanger.

The manually grippable portions 58 and 62 of the arms extend bilaterally and include recesses 102 and 104, respectively, in the outer surface thereof. The recess in one of the arms is adapted to receive an insert 106 which may, for example, identify the manufacturer of the article held by the hanger. Such an insert may simply comprise a thin rubber sheet adhesively bonded in place within the recess. The recess in the manually grippable portion of the other arm may receive an adhesive backing 108 for attaching the clamp 19 to a surface such as that on a toolbox, workbench, cabinet, car trunk, or the like, so that the gloves held by the clamp may be conveniently stored with less likelihood of being misplaced.

The various elements of the clamp shown in FIGS. 1-3 and 7-10 may be molded of an ABS plastic. Accordingly, the jaw portions 60 and 64 may be molded as an integral part of the associated arms 50 and 52. The jaw portions 60 and 64 preferably include inner, confronting toothed, serrated, ridged or otherwise roughened surfaces 110 and 112, respectively, for securely gripping and holding the gloves.

Figure 11:
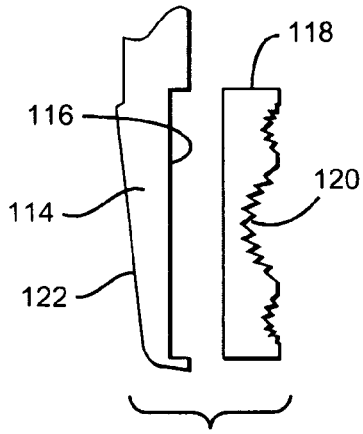
FIG. 11 is an exploded side elevation view of a jaw forming part of a clamp in accordance with an alternative embodiment of the invention.
Figure 13:
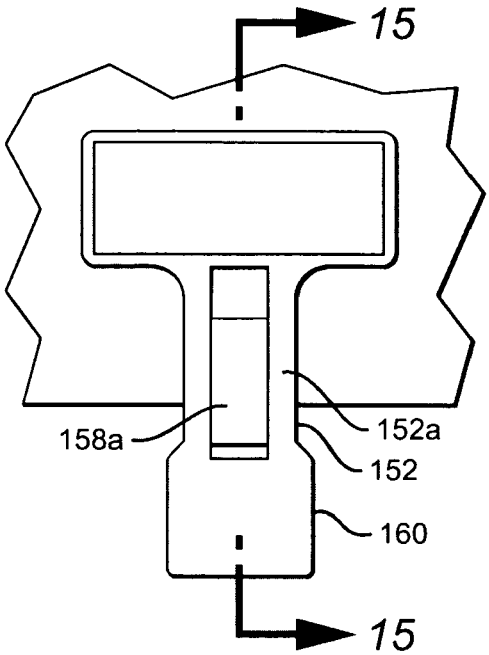
FIG. 13 is a front elevation view of the clamp shown in FIG. 12.
Figure 14:
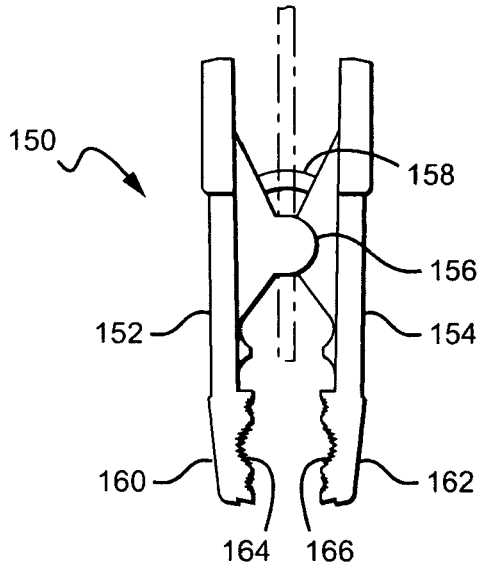
FIG. 14 is a side elevation view of the clamp of FIG. 12.

Alternatively, instead of plastic, the various elements of the clamp 19 may be fabricated of a metal such as magnesium. The elements of such a metallic clamp may be cast, machined, or otherwise formed using well-known metal working or metal forming techniques. With reference to FIG. 11, showing the details of a jaw portion 114 of a metal clamp, the inner surface of the metal jaw portion 114 may be preferably provided with a recess 116 for receiving a resilient insert 118 provided with an appropriate garment gripping surface 120 such as teeth, ridges, or like projections. The outer surface 122 of the jaw portion 114 may receive identifying indicia such as a manufacturer's logo or the like.

Turning to FIGS. 12-17, there is shown a clamp 150 in accordance with an alternative form of the present invention. The clamp 150 may be used with a header along the lines already described to form a hanger for displaying a product such as a pair of gloves. Generally, the clamp 150 of FIGS. 12-17 is similar to the clamp 19 of FIGS. 7-10, the principal differences lying in the structure of the pivot region.

The clamp 150 generally comprises a clothespin-like structure including a pair of opposed, rigid, elongated arms 152 and 154 interconnected at a pivot region 156 between first and second ends of the arms. As before, a generally U-shaped spring clip 158 cooperates with the arms 152, 154 to urge jaw portions 160 and 162 toward each other to clamp and hold gloves or other articles. In this embodiment, the spring clip 158 has opposed flat outer surfaces 158*a* that are flush with flat outer surfaces 152*a* and 154*a* on the arms 152 and 154, respectively. Each of the jaw portions 160 and 162 in this embodiment may have an enhanced article-gripping surface 164, 166 comprising a plurality of parallel, vertically oriented, spaced apart resilient ridges 167.

Figure 15:
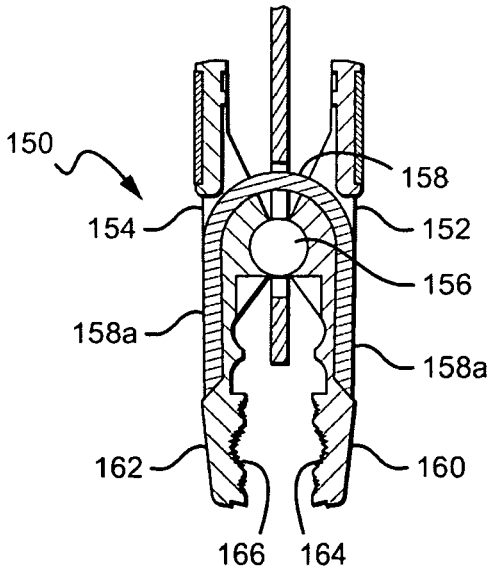
FIG. 15 is a side elevation view, in cross section, of the clamp of FIG. 12 as seen along the line 15-15 in FIG. 13.

The pivot region 156 disposed between the arms 152 and 154, incorporates a pivot structure comprising a plurality of spaced apart, generally cylindrical bearing elements 170 projecting inwardly from the arm 152 and a similar plurality of spaced apart, generally cylindrical bearing elements 172 projecting inwardly from the arm 154. The bearing elements are preferably molded or otherwise formed integrally with the associated arm structure. The projecting bearing elements 170 carried by the arm 152 are interdigitated with the projecting bearing elements 172 carried by the arm 154. Spaces 174 between adjacent bearing elements 170 comprise arcuate bearing surfaces or sockets 176 for receiving the associated bearing elements 172 carried by the arm 154. Similarly, spaces 178 between adjacent bearing elements 172 comprise arcuate bearing surfaces or sockets 180 for receiving the associated bearing elements 170 carried by the arm 152. The bearing elements and their associated bearing sockets are biased into engagement by the spring clip 158. In this fashion, it will be seen that the arms 152 and 154 are able to pivot relative to each other about a horizontal axis 182. Since the bearing elements 170 and 172 are preferably molded integrally with the arms, the embodiment of FIGS. 12-17 comprises a low parts count, low cost construction. With reference to FIG. 15, as before, the pivot region 156 is preferably smaller than the opening in an associated header to permit relative movement between the header and the clamp (see FIGS. 4 and 9). Also, as in the first embodiment, the upper ends of the arms 152 and 154 may include manually grippable portions that may be configured to carry inserts for identifying the manufacturer and/or for attaching the clamp 150 to a support surface. Still further, along the lines shown in FIGS. 1 and 2, a preferably elastic tether may be provided to attach the merchandise carried by the clamp 150 to the associated header.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

What is claimed is:

1. A hanger for displaying and holding an article, the hanger comprising:

a clothespin-like clamp comprising a pair of jaws resiliently biased about a pivot region to a closed, article-holding position; and a header defining an opening for receiving the pivot region of the clamp, said header comprising a sheet folded along a fold edge to define confronting sides, each of said confronting sides including a lower edge parallel with the fold edge and a portion depending from said lower edge, the depending portions of the confronting sides defining said opening.

2. The hanger of claim 1 wherein:

the opening defined by the header is larger than the pivot region so as to provide for relative movement between the clamp and the header.

3. The hanger of claim 1 wherein:

the jaws are disposed below a lower edge of the header.

4. The hanger of claim 1 wherein:

the header comprises a card.

5. The hanger of claim 4 wherein:

the header card has an upper edge opposite the lower edge, the card defining a cutout adjacent to said upper edge configured to receive a merchandise display support.

6. The hanger of claim 1 wherein:

each of said depending portions has an L-shaped configuration.

7. The hanger of claim 1 wherein:

the clamp further includes a generally U-shaped spring for resiliently biasing the jaws, the spring having opposed legs bearing against corresponding outer surfaces of the arms.

8. The hanger of claim 1 wherein:

said legs have outer surfaces flush with outer surfaces of the arms.

9. The hanger of claim 1 wherein:

said clothespin-like clamp comprising a pair of opposed arms pivotable about a pivot region, with said arms each comprising a first end and a second end, said first end of each arm includes a manually grippable portion and said second end of each arm carries one of the jaws of said pair of jaws.

10. The hanger of claim 9 wherein:

the manually grippable portion of at least one of the arms is adapted to receive an insert for carrying identifying indicia or for attaching the clamp to a supporting surface.

11. The hanger of claim 9 wherein:

each of the arms of the pair of arms defines a pivot bearing surface, the pivot bearing surfaces defined by said pair of arms being in confronting relationship, the pivot region further comprising a pivot pin seated within said confronting bearing surfaces.

12. A hanger for displaying and holding an article, the hanger comprising:

a clothespin-like clamp comprising a pair of jaws resiliently biased about a pivot region to a closed, article-holding position, said clamp comprising a pair of opposed arms pivotable about said pivot region, each of the arms of said pair of arms defining alternating bearing elements and bearing sockets, the bearing elements on one of the arms being interdigitated with the bearing elements on the other of said arms and received within corresponding bearing sockets; and a header defining an opening for receiving the pivot region of the clamp.

13. The hanger of claim 12 wherein:

each jaw comprises a plurality of parallel, spaced-apart resilient article-gripping ridges.

14. The hanger of claim 12 wherein:

the header comprises a card.

15. The hanger of claim 14 wherein:

the header card has an other edge opposite the first-mentioned edge, the card defining a cutout adjacent to said other edge, said cutout being configured to engage a merchandise display support.

16. The hanger of claim 14 wherein:

the header comprises a depending portion defining said opening.

17. The hanger of claim 12 wherein:

the header comprises a sheet folded along a fold edge to define confronting sides.

18. A hanger for holding and displaying an article, the hanger comprising:

a header defining an opening, said header comprising a sheet folded along a fold edge to define confronting sides, each of said confronting sides including a lower edge parallel with the fold edge and a portion depending from said lower edge, the depending portions of the confronting sides defining said opening; and a spring-loaded clamp for gripping and holding the article, the clamp comprising:

a pair of opposed, relatively rigid elongated arms, each of the arms of the pair of arms comprising a first end including a manually grippable portion and a second end, opposite the first end, including a jaw portion;

a pivot region including a pivot about which said arms are adapted to rotate, said pivot region being disposed between said first and second ends of the arms; and a U-shaped spring including opposed legs having free ends and a central portion connecting said legs, the central portion passing through openings in said arms, each of the free ends of the U-shaped spring engaging an outer surface of the associated arm at a point between said pivot region and said jaw portion to urge the jaw portions toward each other, the pivot region of the clamp being encompassed by the opening defined by the header, the relative sizes of the opening and the pivot region being such so as to provide for relative movement between the clamp and the header, the jaw portions of the pair of arms being disposed beyond an outer edge of the header so that said jaw portions are engagable with each other without obstruction.

19. The hanger of claim 18 wherein:

each of said depending portions has an L-shaped configuration.

20. The hanger of claim 18 wherein:

each of the arms of the pair of arms defines a pivot bearing surface, the pivot bearing surfaces defined by said pair of arms being in confronting relationship, the pivot region further comprising a pivot pin seated within said confronting bearing surfaces.

21. A hanger for holding and displaying an article, the hanger comprising:

a header defining an opening; and a spring-loaded clamp for gripping and holding the article, the clamp comprising:

a pair of opposed, relatively rigid elongated arms, each of the arms of the pair of arms comprising a first end including a manually grippable portion and a second end, opposite the first end, including a jaw portion, each of the arms of said pair of arms defines alternating projecting bearing elements and bearing sockets, the projecting bearing elements on one of the arms being interdigitated with the projecting bearing elements on the other of said arms and received within corresponding bearing sockets;

a pivot region including a pivot about which said arms are adapted to rotate, said pivot region being disposed between said first and second ends of the arms; and a U-shaped spring including opposed legs having free ends and a central portion connecting said legs, the central portion passing through openings in said arms, each of the free ends of the U-shaped spring engaging an outer surface of the associated arm at a point between said pivot region and said jaw portion to urge the jaw portions toward each other, the pivot region of the clamp being encompassed by the opening defined by the header, the relative sizes of the opening and the pivot region being such so as to provide for relative movement between the clamp and the header, the jaw portions of the pair of arms being disposed beyond an outer edge of the header so that said jaw portions are engagable with each other without obstruction.

22. The hanger of claim 21 wherein:

the legs of the U-shaped spring have outer surfaces that are flush with corresponding outer surfaces of the opposed, elongated arms.

* * * * *